United States Patent [19]

Greene et al.

[11] 4,206,715

[45] Jun. 10, 1980

[54] VEHICLE BODY END CAP AND METHOD OF FORMING SAME

[76] Inventors: Carl B. Greene, both of P.O. Box 948, Chickasha, Okla. 73018; Carl B. Greene, III, both of Chickasha, Okla.

[21] Appl. No.: 903,157

[22] Filed: May 5, 1978

[51] Int. Cl.[2] ..... B21D 53/88

[52] U.S. Cl. ..... 113/116 F; 113/116 C; 29/415; 296/15

[58] Field of Search ..... 296/91, 1 S, 1 R, 32, 296/36, 98 R, 137 R, 29, 24; 113/116 BB, 116 F, 116 C; 29/DIG. 20, 415, 416

[56] References Cited

U.S. PATENT DOCUMENTS

| | | | |
|---|---|---|---|
| 3,389,670 | 6/1968 | Caple | 296/29 |
| 3,820,223 | 6/1974 | Cramb | 113/116 BB |
| 3,999,797 | 12/1976 | Kirsch et al. | 296/1 S |
| 4,036,519 | 7/1977 | Servais et al. | 296/1 S |

*Primary Examiner*—Richard A. Bertsch

*Attorney, Agent, or Firm*—Clarence A. O'Brien; Harvey B. Jacobson

[57] ABSTRACT

A closure for the upper portion of a rounded vehicle body end is provided for spanning between the upper marginal edge of the rounded body end and the adjacent end of the top of the vehicle body. The closure is constructed including marginal portions coextensive with the upper marginal edge of the rounded end of the body and the adjacent end of the body top and the closure includes a component thereof comprising one-half of an intermediate product constructed by stretch forming sheet metal over a male die.

7 Claims, 5 Drawing Figures

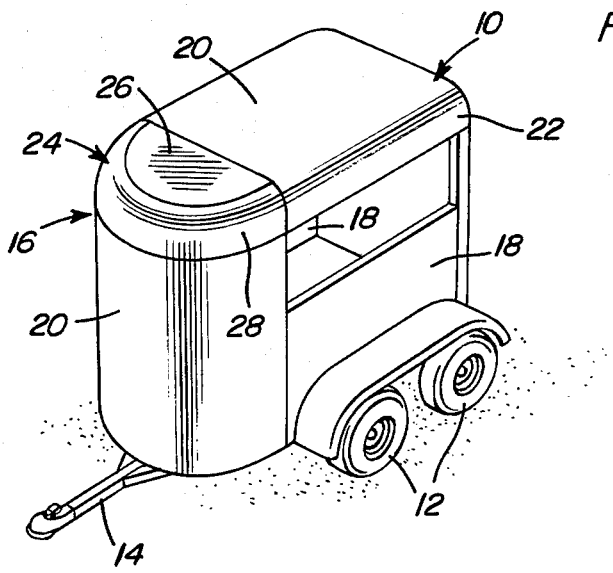
Fig. 1
Fig. 2
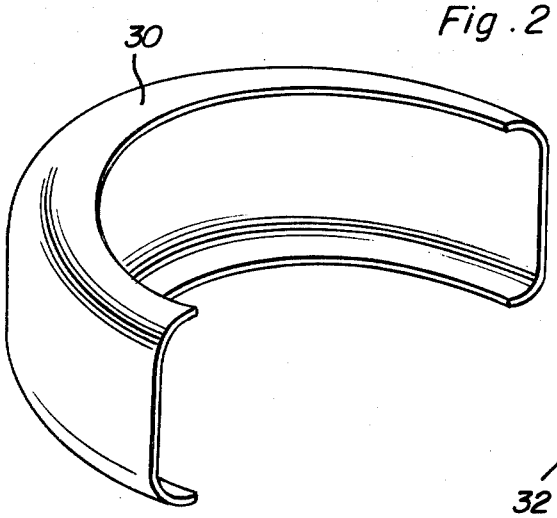
Fig. 3
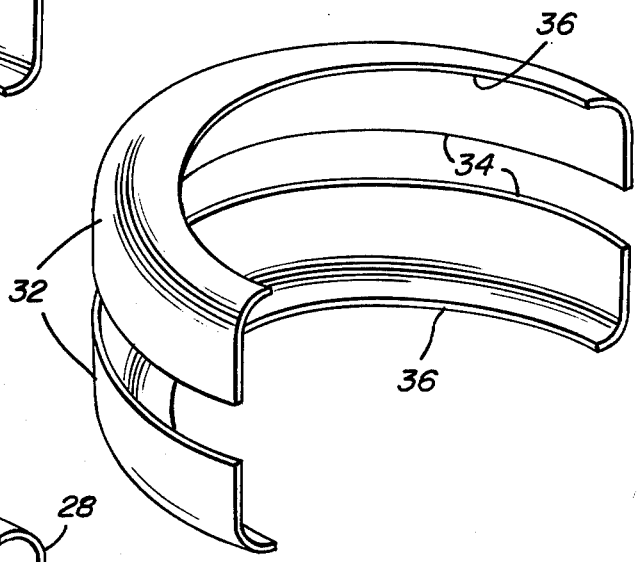
Fig. 4
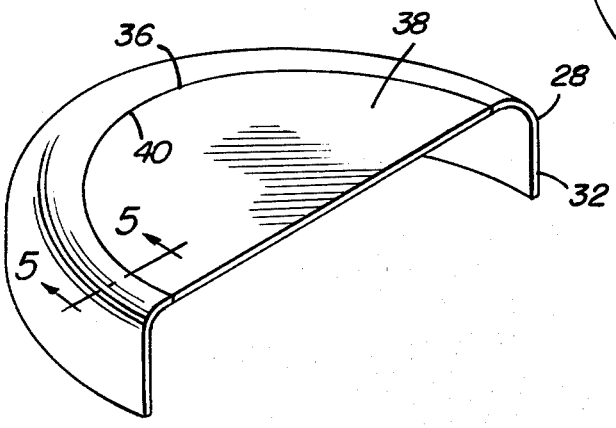
Fig. 5
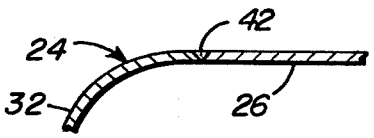

VEHICLE BODY END CAP AND METHOD OF FORMING SAME

BACKGROUND OF THE INVENTION

The end cap of the instant invention comprises a compound curved sheet metal construction for spanning and closing the gap between the upper marginal edge of an outwardly convexly bowed rounded vehicle body end and the adjacent end of a generally flat top for the vehicle body including downwardly curving opposite side marginal portions.

Various similar end caps and methods of forming the same have been heretofore provided, such as those disclosed in U.S. Pat. Nos. 1,707,172 and 3,389,670 as well as the end cap and method disclosed in U.S. Pat. No. 3,820,223. However, these previously known end caps require complex and expensive manufacturing methods and, accordingly, a need exists for a similar end cap which may be produced by simplified inexpensive manufacturing processes.

BRIEF DESCRIPTION OF THE INVENTION

The vehicle body end cap of the instant invention is constructed from one-half of an intermediate produce similar to a generally semi-circular roadster vehicle fender or a motorcycle fender. The intermediate product is then cut in half along its longitudinal arc center line and thereafter, a semi-circular flat sheet metal panel, whose radius of curvature along its semi-circular edge closely corresponds to the short radius of curvature of the longitudinal arc edge of the intermediate product half, is positioned with its semi-circular edge juxtaposed to the short radius of curvature longitudinal arc edge of the intermediate product half and secured thereto by welding. Of course, a second semicircular flat sheet metal section may also have its semicircular edge disposed in juxtaposition to the short radius of curvature longitudinal arc edge of the other half of the intermediate product and secured thereto in order to form a second end cap.

The main object of this invention is to provide a vehicle body end cap of sheet metal which may be produced by relative simple and inexpensive manufacturing processes.

Another object of this invention is to provide a vehicle body end cap utilizing a method whereby the compound curved portions of a pair of end caps may be initially formed as an integral intermediate product with the integral product thereafter cut in a manner so to form the compound curved components of a pair of end caps.

A still further object of this invention is to provide a manufacturing process in accordance with the immediately preceding object and whereby the stresses imparted to the metal being stretched formed during the process of forming the compound curved intermediate product will be evenly distributed throughout the sheet metal being utilized to form the compound curved intermediate product.

A final object of this invention to be specifically enumerated herein is to provide an end cap in accordance with the preceding objects and which will conform to conventional forms of manufacture, be of simple construction and easy to produce so as to provide a device that will be economically feasible, long lasting and readily manufacturable by simplified manufacturing processes.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a trailer whose body portion employs the end cap of the instant invention at the upper forward portion of the trailer body;

FIG. 2 is a perspective view of the intermediate product formed initially in constructing the end cap;

FIG. 3 is and exploded perspective view of the two compound curved components which are formed when the intermediate product of FIG. 2 is cut in half;

FIG. 4 is a prospective view of an end cap which has been constructed utilizing one of the half components illustrated in FIG. 3; and FIG. 5 is an enlarged fragmentary vertical sectional view taken substantially upon the plane indicated by the section line 5—5 of FIG. 4.

DETAILED DESCRIPTION OF THE INVENTION

Referring now more specifically to the drawings, the numeral 10 generally designates a horse trailer which may be of conventional construction and includes tandem supporting wheels 12, a towing tongue 14 and a body referred to in general by the reference numeral 16. The body 16 includes opposite side walls 18, a forwardly convex semi-cylindrical forward wall 20 interconnecting the forward ends of the side walls 18 and a generally flat horizontal top wall 20 including downwardly radiused or curved opposite side marginal edges 22. The lower ends of the opposite side marginal edges 22 are substantially coextensive with the side walls 18 and the rear marginal portions of the lower portions of the front wall 20 are substantially coextensive with the forward ends of the side walls 18.

The end cap of the instant invention is referred to in general by the reference numeral 24 and is constructed of sheet metal. The end cap 24 includes a top portion 26 which is substantially planar and generally semi-circular in plan shape and the top portion 26 forms a forward continuation of the forward end of the top wall 20 disposed between the downwardly radiused opposite side marginal portions 22 thereof. In addition, the end cap 24 includes a compoundly curved portion 28 which curves between the forward ends of the opposite side marginal portions 22 of the top wall 20 and between the upper marginal edge of the front wall 20 and the semi-circular edge of the top portion 26.

In forming the end cap 24, a substantially semi-cylindrical sheet metal member 30 is formed by stretch forming about a semi-circular male die including radiused opposite side marginal edges. The sheet metal member 30 may be seen to be generally channel-shaped in cross section and to have the configuration of a roadster-type vehicle fender or a motorcycle fender of substantially 180 degrees angular extent. Roadster fenders, boat trailer and motorcycle fenders of this configuration have been previously constructed by stretch forming and other manufacturing processes.

Once the sheet metal member 30 has been constructed it is cut along its longitudinal arc center line in order to form a pair of identical half sections 32 including long and short radius of curvature longitudinal arc edges 34 and 36. After the member 30 has been cut into the two half sections 32, one of the half sections 32 has a flat semi-circular sheet metal section 38, whose radius of curvature of its semi-circular edge 40 corresponds, substantially, to the short radius of curvature longitudinal arc edge 34 of the half section 32, positioned with its edge 40 in juxtaposition to the edge 36 of the half section 32 and is welded, as at 42 in position. Thus, the top portion 26 is secured to the half section 32 in order to form the desired end cap 24.

As will be noted from FIG. 5 of the drawings, the semi-circular edge 40 of the section 38 is disposed in edge abutting relation with the edge 36 of the section 32 before the welding operation as at 42 is carried out. Accordingly, the upper and lower surfaces of the top portion 26 are coextensive with the adjacent upper and lower surfaces of the half section 32. Of course, the remaining half section 32 may have a second semi-cylindrical sheet metal section 38 secured thereto in the same manner in order to form a second end cap. Therefore, it may be seen that a pair of end caps 24 may be readily constructed by utilizing a pair of semi-circular sheet metal sections 38 and by forming one of the sheet metal members 30, cutting the latter in half and then securing the two semi-cylindrical sheet metal sections 38 to the half sections 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is clained as new is as follows:

1. The method of forming a closure end cap between an upstanding end wall of a vehicle body and a substantial horizontal roof of the body in which the roof is provided with a substantially flat top portion and downwardly curved side edge portions and the end wall is provided with rearwardly extending and generally parallel side edge portions and a generally semi-cylindrical curved front portion, said method comprising forming a semi-cylindrical sheet metal member of substantially C-shape cross section to form an intermediate product, cutting the sheet metal member in half along its longitudinal arc centerline, positioning a generally semi-circular flat sheet metal section, whose radius of curvature along its generally semi-circular edge closely corresponds to the short radius of curvature longitudinal arc edge of one of the halves of said sheet metal member, with its semi-circular edge juxtaposed said short radius of curvature longitudinal arc edge of said one half member, and securing the juxtaposed edges of said member and section together.

2. The combination of claim 1 wherein the step of securing said juxtaposed edges together includes welding the latter edges together.

3. The combination of claim 1 wherein the step of positioning the semi-circular edge of said section juxtaposed said short radius of curvature longitudinal arc edge of said one half includes the step of positioning the last mentioned two edges in edge abutting relation.

4. The combination of claim 3 wherein the step of securing said juxtaposed edges together includes welding the latter edges together.

5. The combination of claim 1 wherein the step of forming said semi-cylindrical sheet metal member includes the step of stretch forming a generally rectangular sheet metal section about a generally semi-cylindrical male die member including inwardly radiused opposite side marginal portions.

6. The combination of claim 5 wherein the step of securing said juxtaposed edges together includes welding the latter edges together.

7. The combination of claim 6 wherein the step of positioning the semi-circular edge of said section juxtaposed said short radius of curvature longitudinal arc edge of said one half includes the step of positioning the last mentioned two edge abutting relation.

* * * * *